United States Patent [19]

Campbell et al.

[11] Patent Number: 4,807,505

[45] Date of Patent: Feb. 28, 1989

[54] BAGEL SLICER

[75] Inventors: Stephen N. Campbell, Fort Lauderdale, Fla.; John U. Thurnheer, Ithaca, N.Y.

[73] Assignee: Tc Bagel Cutter, Inc., Ithaca, N.Y.

[21] Appl. No.: 76,611

[22] Filed: Jul. 23, 1987

[51] Int. Cl.[4] ..... B26D 7/02

[52] U.S. Cl. ..... 83/454; 83/762; 269/87.2

[58] Field of Search ..... 83/454, 761, 762, 763, 83/764, 765; 30/124, 289; 269/87.2

[56] References Cited

U.S. PATENT DOCUMENTS

| | | | |
|---|---|---|---|
| 2,206,154 | 7/1940 | Bixler | 83/762 |
| 2,679,274 | 7/1951 | Criner . | |
| 3,018,806 | 1/1958 | Moore . | |
| 3,338,282 | 8/1967 | Blum . | |
| 3,347,296 | 10/1967 | Rothman | 269/87.2 |
| 4,249,445 | 2/1981 | Browning | 83/762 |
| 4,399,989 | 8/1983 | Baillie | 269/87.2 |
| 4,546,686 | 10/1985 | Losiowski et al. | 83/874 |
| 4,550,636 | 11/1985 | Josselson et al. | 83/743 |

*Primary Examiner*—Donald R. Schran

*Assistant Examiner*—Eugenia A. Jones

*Attorney, Agent, or Firm*—Ralph R. Barnard

[57] ABSTRACT

The present invention is an apparatus for slicing bagels or the like and includes: a base; a pair of face-matching blocks mounted vertically on the base, each of the face-matching blocks having a chamber therein facing and matching the other, which together forms a chamber generally the shape of a bagel, as well as providing a slot to receive a knife and to allow the knife to pass completely through the bagel-like bread on its longest dimension; a hinge positioned on the vertical dimension of one of the face-matching blocks, the top portion of which is hinged with respect to its remaining bottom portion to open and allow for insertion and removal of the bagel-like bread to be sliced; a pin extending into the chamber from the chamber surface of the hinged block, which when closed in an operative position causes the pin to penetrate the bagel and thereby restrict the movement of the bagel-like bread during the slicing operation; and a thumb grip formed in the top of each of the face-matching blocks for the purpose of aiding the user in holding the two together and assuring that the free hand, not using the knife, is out of the way of the sharp blade.

2 Claims, 1 Drawing Sheet

BAGEL SLICER

BACKGROUND OF THE INVENTION

This invention relates to improvements in apparatus for slicing bagels or the like into two halves.

A bagel is a hard roll which is usually circular in formation with a hole in the center. It is ordinarily served by first slicing it. Because of the hardness of the bagel crust and the comparative narrowness of the bagel, it is easy for the bread knife to slip and injure the person slicing the bagel. The prior art has taught many solutions to this problem, yet improvements may be made to the existing art. Most prior art devices do not prevent the bagel-like bread from rolling within the slicing device and as a result they are not very efficient. Others are complex and not meant for simple everyday use in the home. Some of the devices still expose the user to the sharp edge of the knife blade.

Therefore, it is the primary object of the present invention to provide an apparatus which both holds the bagel and provides means for guiding the knife. Because movement of the bagel and slippage of the knife are prevented, efficient slicing of the bagel in combination with simplicity of use is ensured.

It is a further object of the present invention to provide a simple and inexpensive apparatus for slicing bagels which is also safe and sturdy enough to withstand frequent use.

It is a further object of the present invention to provide an apparatus which slices bagels into two uncompressed and unbroken slices, each having a thickness of approximately one half that of the original bagel.

It is a further object of the present invention to provide an apparatus which provides for slicing bagels or the like of various sizes without detracting from the efficiency and simplicity of the slicer.

SUMMARY OF THE INVENTION

The present invention is a safe, efficient, attractive, and sturdy bagel slicer, which is especially adapted to holding a bagel or the like and providing a means for guiding the knife, such that a bagel may be divided into two generally equal halves without damaging the bagel or injuring the person slicing it. A bagel is easily inserted into and removed from the bagel slicer by moving the hinged portion of one of two face-matching blocks which stand adjacent to one another and together form a circular chamber into which the bagel is inserted and securely held. The aforesaid hinge being positioned on the vertical dimension of the hinged face-matching block such that the hinged portion extends well into the lower half of the bagel. If the hinged portion of that block moves vertically toward the center of the bagel, the insertion of the bagel becomes more difficult. If the bagel is smaller than the chamber formed by the face-matching blocks, it tends to rotate and/or move during the slicing operation. To avoid this problem, a significant feature of the present invention is to place a pin, such as (8), on the inner surface of the chamber such that when the hinged block is closed the pin penetrates the bagel. A slot between the two faces of the blocks provides a means for guiding a conventional bread knife through the middle of the bagel. Thumb grips are provided on the top of each of the face-matching blocks for the purpose of encouraging the user to hold the slicer from the top during slicing, thus assuring that the free hand cannot be injured by the sharp edge of the knife blade.

DESCRIPTION OF THE INVENTION

In each figure the reference numbers are the same, thus each number will always refer to the same part.

Figure 1:
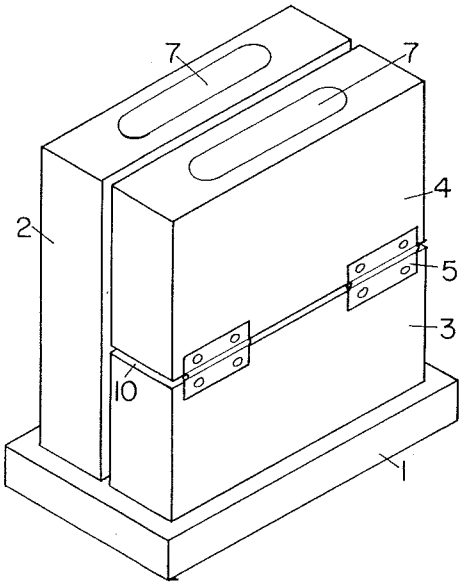
FIG. 1 is a perspective view of the invention in a closed operative position.

Looking at FIG. 1, the bagel slicing apparatus (14) in a preferred embodiment consists of two face-matching wooden blocks (2) and (2*a*), preferably made of an attractive and sturdy material (one example of which is oak), which have a width and height of 5" and have a thickness of $1\frac{1}{4}$", standing vertically and adjacent to one another on a base (1). A slot (6), slightly larger than the width of a conventional bread knife (less than $\frac{1}{4}$"), is provided between the two blocks as a means for guiding the slicing knife. One of the blocks, (2*a*), is divided well into the lower half, such as one quarter of the way up from the base, at division (10) into two pieces (3) and (4), such that they are placed end to end and hinged to each other along adjacent ends by hinge means (5). The degree to which the hinge point is positioned below the middle of the bagel is a matter of preference. However, it ought to be sufficiently low that it will allow the bagel-like bread to be inserted, but not so low as to detract from the integrity of the chamber in its ability to hold the bagel-like bread by itself before the slicing operation. While hinge means (5) is shown as two hinges, the use of one hinge on a centered position may be preferable in many instance without departing from the teachings of the present invention.

Figure 3:
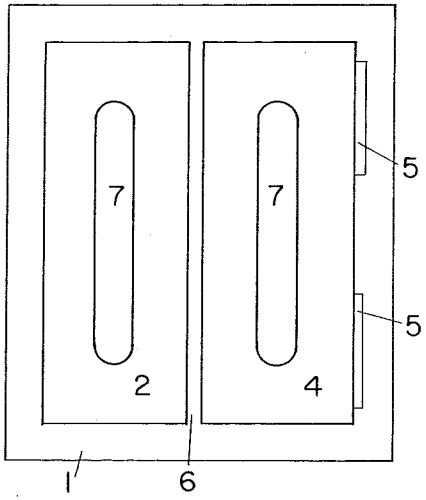
FIG. 3 is a top view of the preferred embodiment of the invention.
Figure 2:
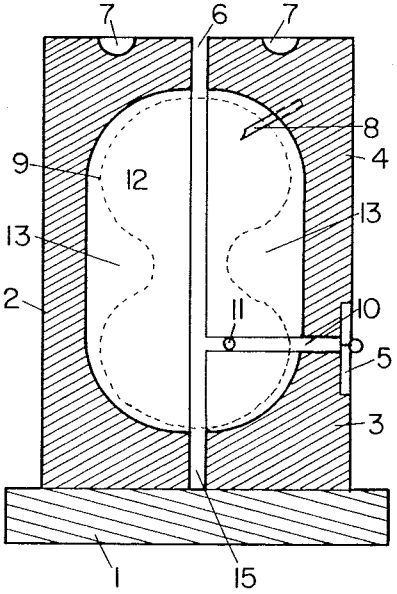
FIG. 2 is a vertical sectional view of the invention in a closed operative position with a bagel shown in place in the inner circular chamber.

As illustrated in FIG. 2, the center of each block (2) and (2*a*), contains a circular chamber (12), the cavities extending in opposed relation toward each other. In operation, the hinged block (4) swings downwardly to a position that is perpendicular to its original postion. A bagel (9) is easily inserted into and removed from the chamber (12) of the bagel slicer when the hinged block (4) is in this receptive position. Therefore, it is the relative positioning of the hinge means (5) on the vertical dimension of the hinged face-matching block (2*a*) that makes the present invention especially efficient and simple to operate. As the hinged block (4) is returned to an upright position, the pin (8), which extends from the top of the circular chamber of the hinged block (4), simultaneously penetrates the bagel. A small black rubber bumper (11) having a height of $\frac{1}{4}$" and a width of $\frac{3}{8}$", is attached to either the hinged portion (94) or the remaining portion (3) of the hinged face-matching block (2*a*) at division (10) for the purpose of giving support to the hinge means when the bagel slicer is in the closed operative position.

When fully closed, the bagel slicer will hold a bagel which is up to $1\frac{1}{2}$" thick and has a diameter of up to $4\frac{1}{4}$". Once the selected bagel is in position with the bagel slicer closed, the user may insert a bread knife into slot (6) and begin slicing the bagel. When the blade of a conventional bread knife is being employed, the slicing movements thereof are guided by the edges of the slot (6). The thumb grip (7) located on the top of each of the face-matching blocks is a special safety feature which allows the user to hold the bagel slicer securely during slicing without getting his hands near the sharp knife blade. The space (15) below the circular chamber allows the bread knife to come to a rest after fully slicing through the bagel, thus sparing the slicer itself from the sharp edge of the knife. Moreover, a material such as nylon may be placed in the lower part of space (15) for the knife to ride on without cutting into the base over time. This would be a matter of design and would not depart from the teachings of the present invention.

The circular chamber (12) reduces the horizontal and vertical movement of the bagel, making the bagel slicer efficient and particularly adapted to its object of securely holding the bagel. Furthermore, the pin (8) is a special feature of the invention, as it prevents the bagel from rolling within the circular chamber of the bagel slicer during slicing. This additional and improved feature perfects the performance of the slicer and prevents the destruction of the sliced faces of the bagel by holding the bagel securely, allowing it to be cut smoothly and evenly. While chamber (12) is shown to cooperate with the bagel-like bread (8) such that voids (13) are not filled by the bagel and such an arrangement does not detract from the operation of the bagel holder, one or the other or both of the face-matching blocks could protrude and fill the void within the teachings of the present invention.

The present invention relates to improvements in apparatus for slicing bagels or the like and includes: a base means (1); a pair of face-matching block means (2) and (2*a*) mounted vertically on said base means, each of said face-matching block means having a chamber (12) therein facing and matching the other, which together forms a chamber generally the shape of a bagel, as well as providing a slot (6) to receive a knife and to allow the knife to pass completely through the bagel-like bread on its longest dimension; hinge means (5) positioned on the vertical dimension of one of said face matching block means (2*a*), the top portion (4) being hinged with respect to its remaining bottom portion (3) to open and allow for insertion and removal of the bagel-like bread to be sliced; a pin (8) extending into the chamber from the chamber surface of the said hinged block (4), which when closed in an operative position causes the pin to penetrate the bagel and thereby restrict the movement of the bagel-like bread during the slicing operation; and thumb grip (7) formed in the top of each of said face-matching blocks for the purpose of aiding the user in holding the two together and assuring that the free hand, not using the knife, is out of the way of the sharp blade.

The foregoing description has been directed to particular embodiments of the invention in accordance with the requirements of the Patent Statues for the purposes of illustration and explanation. It will be apparent, however, to those skilled in this art that many modifications and changes will be possible without department from the scope and spirit of the invention. It is intended that the following claims be interpreted to embrace all such modifications and changes. For example, it would be recognized that the size and shape of bagel-type bread may and does very based on many factors and accordingly, the size and shape of the chamber (12) will vary.

What is claimed is:

1. A slicer guide for bagel-like bread comprising:

(a) base means;

(b) a pair of face-matching block means having a slot therebetween to receive a knife mounted vertically on said base means;

(c) each of said face-matching block means having a cavity therein facing and matching the other which together forms a chamber generally the shape of a bagel to fully enclose the said bagel-like bread, said slot to receive a knife has a sufficient space below said chamber to allow the knife to pass completely through the bagel-like bread on its longest dimensions;

(d) the top part of one of said face-matching block means being hinged with respect to its remaining bottom part to open and allow for insertion and removal of the bagel-like bread to be sliced;

(e) a pin extending into said chamber from the upper half of the chamber surface of said hinged face-matching block, which when closed in an operative position causes the pin to penetrate the bagel-like bread and thereby restrict the movement of the bagel-like bread during the slicing operation;

(f) the said hinge being positioned on the vertical dimension of said hinged face-matching block above the bottom of the chamber such that the hinged portion extends sufficiently far into the lower half of the bagel shaped chamber allowing easy insertion and removal of the bagel-like bread.

2. The bagel slicer of claim 1 wherein a thumb grip is formed on the top of each of said face-matching blocks for the purpose of aiding the user in holding the two together and assuring that the free hand, not using the knife, is out of the way of the sharp blade of said knife.

* * * * *